United States Patent [19]

Wicklander

[11] 4,111,215

[45] Sep. 5, 1978

[54] COIN SORTING MECHANISM

[76] Inventor: Gösta Wicklander, 1 Skonertvagen, Alnö, Sweden, S-860 24

[21] Appl. No.: 749,394

[22] Filed: Dec. 8, 1976

[30] Foreign Application Priority Data

Dec. 15, 1975 [SE] Sweden ..... 7514135

[51] Int. Cl.[2] ..... G07D 3/04

[52] U.S. Cl. ..... 133/3 C

[58] Field of Search ..... 133/3 C, 3 R, 3 A, 3 B, 133/3 D, 3 E, 3 F, 3 G, 3 H

[56] References Cited

U.S. PATENT DOCUMENTS

| | | | |
|---|---|---|---|
| 215,846 | 5/1879 | Tyler | 133/3 C |
| 1,458,515 | 6/1923 | Boring et al. | 133/3 C |
| 3,040,858 | 6/1962 | Almquist | 133/3 R |

FOREIGN PATENT DOCUMENTS

| | | | |
|---|---|---|---|
| 1,449,143 | 1/1969 | Fed. Rep. of Germany | 133/3 R |

*Primary Examiner*—Stanley H. Tollberg
*Attorney, Agent, or Firm*—Haseltine, Lake & Waters

[57] ABSTRACT

A coin sorting mechanism having a coin passage for travel of coins to be separated according to diameter and a sorting mechanism for sorting the coins according to diameter. The sorting mechanism comprises a succession of deflection bars having respective graduated sorting holes for deflecting from the coin passage, coins, disks and the like with a diameter greater than the sorting hole in the respective deflection bar. The sorted coins are gravitationally conveyed by the respective bars for discharge into compartments at a receiving station. Each bar is provided with a further sorting hole located along the path of travel of the deflected coins in proceeding for discharge from the bar to the receiving station. The further sorting hole has an extent in one direction which is less than the diameter of the coin which the respective deflection bar is to divert whereby undersized coins are discharged from the deflection bar before they have reached the location for discharge to the receiving station. A channel is positioned beneath the further sorting holes of all of the deflection bars for receiving undersized coins from the bars for deposit into a collecting container. Each of the deflection bars consists of two separate portions which are adjustably connected to adjust the sizes of both sorting holes in each deflection bar.

9 Claims, 4 Drawing Figures

COIN SORTING MECHANISM

This invention relates to a coin sorting mechanism of the type for sorting coins with respect to their diameter. The invention has the object of providing such a mechanism, which is of a simple design, cheap to manufacture, reliable in operation and capable to sort out foreign coins, disks and similar objects having a deviating diameter.

This object is achieved thereby that the coin sorting mechanism according to the invention has been given the characterizing features defined in the attached claims.

Figure 1:
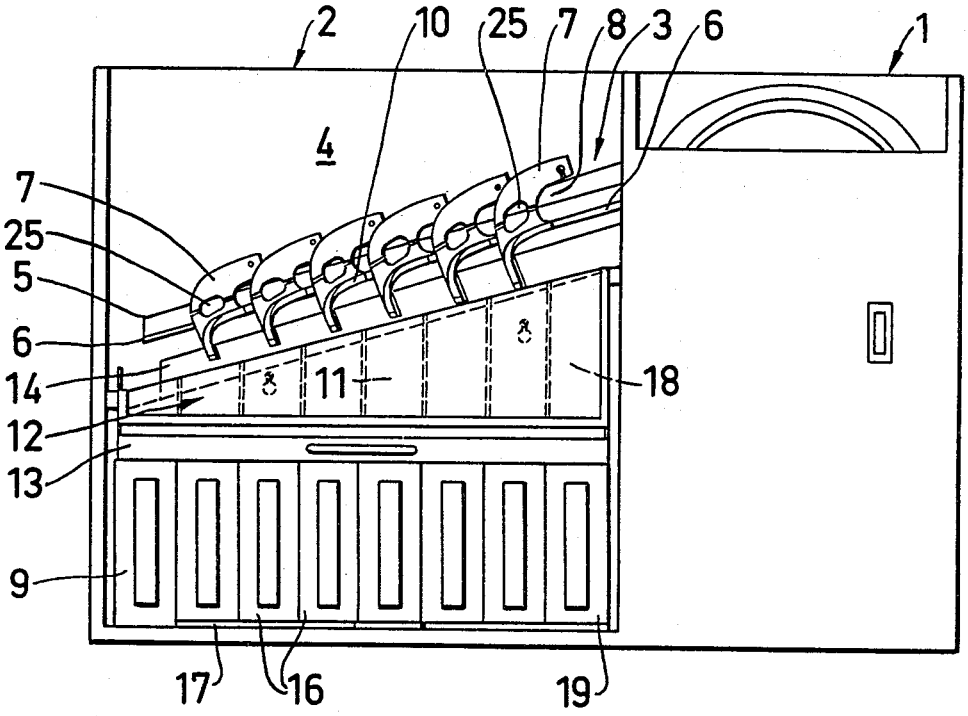
Figure 2:
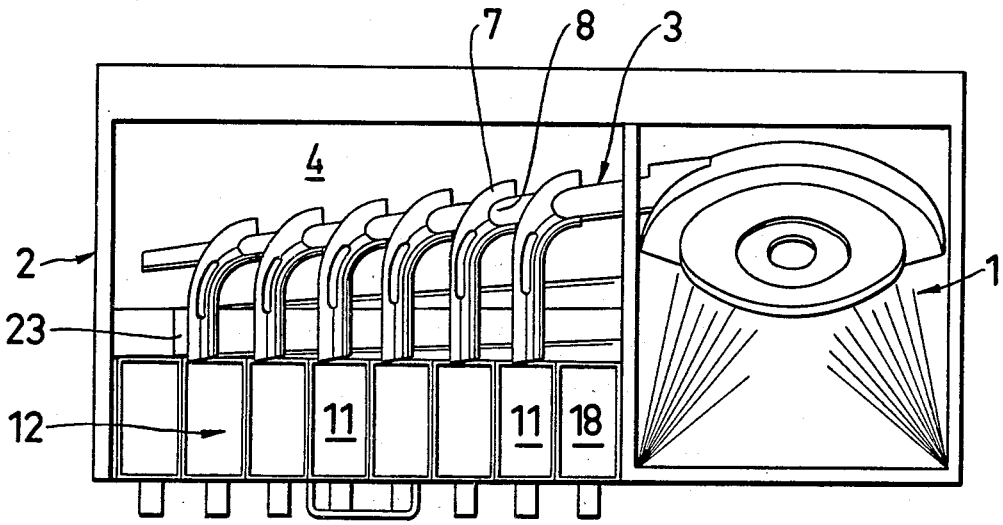
Figure 3:
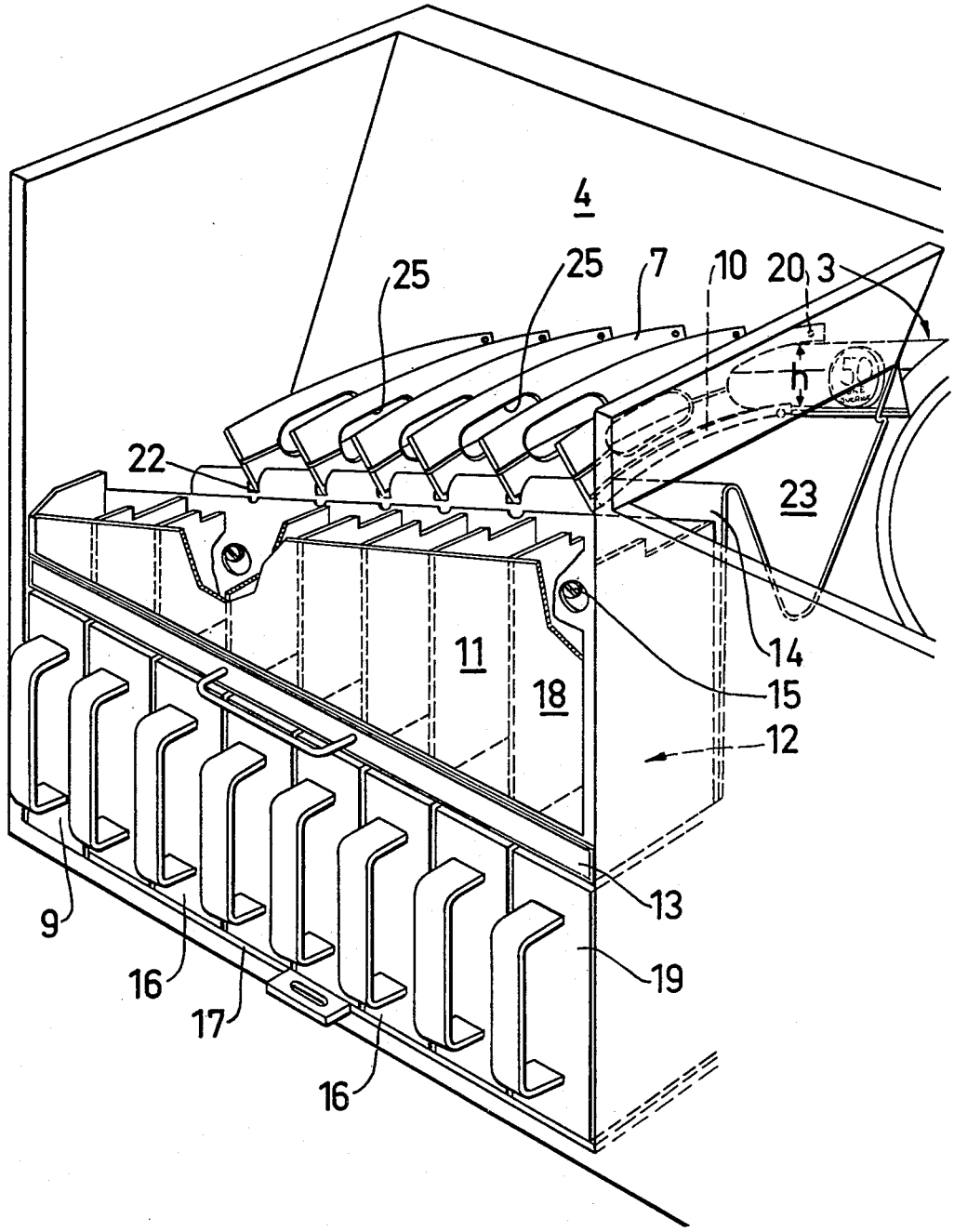
Figure 4:
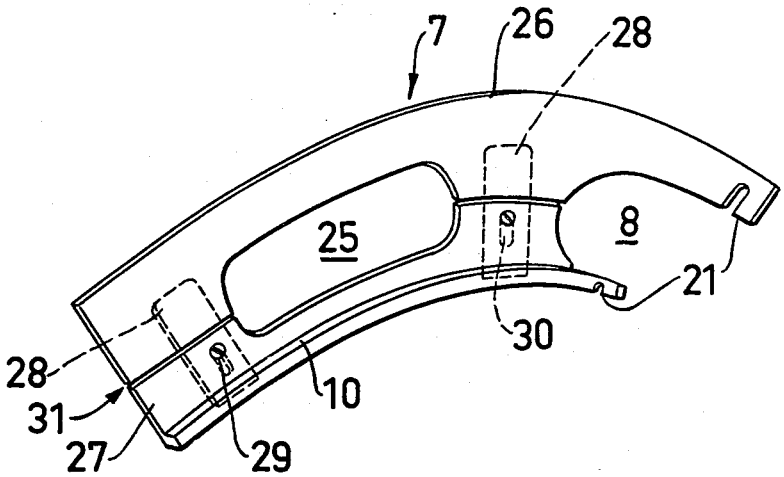

The invention is described in greater detail in the following, with reference to the accompanying drawings, in which FIG. 1 is a front view of a coin sorter provided with a coin sorting mechanism according to the invention, FIG. 2 is a view from above of the sorter shown in FIG. 1, FIG. 3 is a perspective view of the coin sorting part of the sorter shown in FIGS. 1 and 2, and FIG. 4 is a perspective view of one of the coin deflecting bars in the coin sorting mechanism according to the invention.

The coin sorter shown in the drawings comprises a coin hoisting mechanism 1 and a coin sorting mechanism 2 according to the invention. The coin hoisting mechanism may be of any known type and does not constitute a part of the present invention. The coin is transferred from the hoisting mechanism 1 to the sorting mechanism 2 on an inclined coin passage 3, which consists of a scooped-out bar 5 attached to the rear wall 4 and a projecting strip or edge 6, on which the coins roll inclined against the bar 5 until they are deflected from the coin passage 3 by one of a multitude of curved deflection bars 7 provided one after the other in a number corresponding to the number of coin denominations in question, which bars at their ends connected to the coin passage 3 are provided with sorting holes 8. Said sorting holes in the deflection bars 7 have varying heights *h* adjusted to the coin diameters in question and are arranged in decreasing height, which implies that all coins, disks and the like having a diameter exceeding the height *h* of the sorting hole in the first deflection bar cannot pass through said hole, but are deflected from the coin passage 3 by the first deflection bar 7, while coins, disks and the like with a diameter smaller than the height of said sorting hole pass through the hole and are then deflected by one of the subsequent deflection bars 7. At the embodiment shown, the deflection bars are arranged so as to deflect coins with the demoninations 5 crowns, 1 crown, 50 ore, 5 ore, 25 ore and 10 ore in said order. Coins, disks and other objects such as buttons passing through the sorting hole 8 of the last deflection bar roll down into a collecting container 9 disposed at the end of the coin passage 3 and beneath the same for sorting out coins, disks, buttons and the like.

Each coin deflected from the coin passage 3 by the deflection bars 7 rolls on the roll track 10 of the respective deflection bar, which track is located on the same level as the edge 6 of the coin passage, down into a compartment 11 in an intermediate station 12, which is provided with a pull-out bottom and can be removed from the coin sorting mechanism for control of the sorted coins collected in said intermediate station. The intermediate station 12, more precisely, is suspended on screws 15 provided on a wall 14 as shown especially in FIG. 3. Beneath the compartments 11 of the intermediate station 12 separate pull-out collecting containers 16 are provided for the different coin denominations. In the embodiment shown, said containers are arranged on a plate 17 common for all containers so that they simultaneously can be removed from and inserted into the coin sorting mechanism. When the bottom 13 of the intermediate station is pulled out, the coins lying in the compartments of said station drop down into the respective collecting container 16. A reserve compartment in the intermediate station is designated by 18, and 19 is a collectiong container located beneath this compartment.

At its end facing toward the coin passage 3, each deflection bar 7 is detachably attached to the rear wall 4 and the coin passage 3 by means of screws 20, onto which the deflection bar 7 with its hook-shaped end portions 21 located on both sides of the sorting hole 8 can be hooked, and its other end is fixed in a recess 22 in the wall 14, on which the intermediate station 12 is suspended, and said bar terminates above its compartment 11 in the intermediate station.

According to the present invention, beneath all deflection bars 7 a sorting-out groove 23 is provided which is inclined downward from the partition wall 24 between the hoisting mechanism and the coin sorting mechanism and extends all the way to the collecting container 9 for sorted-out coins, disks and the like. Above said sorting-out groove 23, over which the deflection bars 7 form a bridge, said bars are provided with a sorting-out hole 25 of oblong configuration. The sorting-out hole 25 of each deflection bar has a height, which is slightly, for example one or some tenths of a millimeter, larger than the sorting hole 8 of the respective deflection bars, the height *h* of which is determined by the diameter of the largest coin to be permitted to pass. Coins, disks and other foreign objects having a diameter exceeding that of the sorting hole 8 of a deflection bar, but smaller than that of the sorting-out hole 25 of this bar, thus, will be deflected by the deflection bar 7 in question from the coin passage 3 and then drop out through the sorting-out hole 25 of the deflection bar and down into the sorting-out groove 23, from which it is forwarded to the collecting container 9 for sorted-out coins, disks and the like.

Each deflection bar 7, further, consists of two separate portions 26 and 27, which are interconnected in such a way, that the height or diameter of the sorting hole 8 as well as of the sorting-out hole 25 can be adjusted as desired, whereby it is possible to adapt the present coin sorting mechanism to coins of different kind. The two portions 26 and 27 of the deflection bar, more precisely, are connected to each other by two transverse pieces 28, which are rigidly connected with one portion 26 or 27 and adjustably connected with the other portion 27 or 26 by means of screws 29 provided in said lastmentioned portion. Said screws extend through oblong holes 30 into the transverse pieces 28 and are on the rear side provided each with a tightenable nut, which is not apparent from the drawings, by means of which nuts the two portions 26 and 27 of the deflection bar can be locked in their positions set relative to each other. The invention, of course, is not restricted to the device shown for adjusting the holes 8 and 25 of the deflection bar, but any other device or arrangement rendering it possible to change the gap 31 between the two portions 26 and 27 constituting the deflection bar is comprised in the invention. It is, thus, possible according to the invention, by changing the width of the gap 31 to adjust the height or diameter of the sorting hole as well as of the sorting-out hole in agreement with the coin diameters to be sorted.

Though not shown in detail in the drawings, the coin sorting mechanism according to the invention is intended to comprise means for counting each sorted coin dropping down into the respective compartment. Said means, for example, may be photocells or similar expedient means, disposed directly in connection to the outlet end of the deflection bars. The coin sorting mechanism may also be provided with a figure transducer connected to the counting means and showing the counted amount.

The present invention is not restricted to the embodiment described above and shown in the drawings, but it can be altered and modified in many different ways within the scope of the inventive idea as it is defined in the claims.

What I claim is:

1. A coin sorting mechanism comprising a coin passage for travel of coins to be separated according to diameter and means coupled to said passage for sorting the coins according to diameter, the latter said means comprising a succession of deflection bars having respective graduated sorting holes for deflecting from the coin passage, coins, disks and the like with a diameter greater than the sorting hole in the respective deflection bar, means on each said bar for gravitationally conveying the deflected coins along the bar for discharge therefrom, a receiving station having compartments for receiving the sorted coins, each said bar being provided with a further sorting hole located along the path of travel of the deflected coins in proceeding for discharge from the bar to the receiving station, said further sorting hole having an extent in one direction which is less than the diameter of the coin which the respective deflection bar is to divert, said further sorting hole being positioned with respect to the coin conveying means of the respective deflection bar for discharge of undersize coins before they have reached the location of discharge from the bar to the receiving station and channel means positioned beneath the further sorting holes for receiving undersized coins from said deflection bars.

2. A coin sorting mechanism as claimed in claim 1 comprising means for adjusting the sizes of each of the sorting holes in each deflection bar.

3. A coin sorting mechanism as claimed in claim 2 wherein each deflection bar comprises two interconnected parts each respectively being provided with a portion of each respective sorting hole and said further sorting hole, said means for adjusting the sizes of the holes comprising means adjustably connecting said parts together.

4. A coin sorting mechanism as claimed in claim 3 wherein said means adjustably connecting the parts together comprises strip means affixed to one of said parts and attachment means adjustably connecting the other part to said strip means.

5. A coin sorting mechanism as claimed in claim 1 wherein said channel means is provided with a sorting-out groove, said groove being inclined downwardly, and a container for undersized coins, said groove extending to said container.

6. A coin sorting mechanism as claimed in claim 1 comprising collecting containers beneath said compartments.

7. A coin sorting mechanism as claimed in claim 6 comprising a pull-out bottom as said receiving station for transferring the sorted coins in the compartments to said collecting containers.

8. A coin sorting mechanism as claimed in claim 7 wherein said compartments of said receiving stations are removable.

9. A coin sorting mechanism as claimed in claim 1 comprising means detachably supporting each deflection bar from stationary structure.

* * * * *